US009884228B2

(12) United States Patent
Yadav

(10) Patent No.: US 9,884,228 B2
(45) Date of Patent: Feb. 6, 2018

(54) RACKET-STRINGING MACHINE

(71) Applicant: Chethan Yadav, Atlanta, GA (US)

(72) Inventor: Chethan Yadav, Atlanta, GA (US)

(73) Assignee: Chethan Yadav, Atlanta, GA (US)

( * ) Notice: Subject to any disclaimer, the term of this patent is extended or adjusted under 35 U.S.C. 154(b) by 122 days.

(21) Appl. No.: 14/863,013

(22) Filed: Sep. 23, 2015

(65) Prior Publication Data

US 2017/0080298 A1 Mar. 23, 2017

(51) Int. Cl.
*A63B 51/14* (2006.01)
*A63B 51/015* (2015.01)

(52) U.S. Cl.
CPC ..... *A63B 51/14* (2013.01); *A63B 51/015* (2015.10)

(58) Field of Classification Search
CPC ... A63B 51/14; A63B 51/16; A63B 2051/146; A63B 51/015
See application file for complete search history.

(56) References Cited

U.S. PATENT DOCUMENTS

| | | | | |
|---|---|---|---|---|
| 4,270,752 | A | 6/1981 | Strelow | |
| 4,484,742 | A | 11/1984 | McCrone et al. | |
| 5,820,500 | A | 10/1998 | Raos | |
| 7,153,226 | B1 | 12/2006 | Van Der Pols | |
| 2008/0214337 | A1 | 9/2008 | Tsuchida | |
| 2008/0254922 | A1* | 10/2008 | Severa | A63B 51/14 473/556 |
| 2008/0254923 | A1* | 10/2008 | Severa | A63B 51/14 473/557 |
| 2008/0254924 | A1* | 10/2008 | Severa | A63B 51/14 473/557 |
| 2010/0227716 | A1* | 9/2010 | Severa | A63B 51/14 473/557 |
| 2011/0111893 | A1* | 5/2011 | Severa | A63B 51/14 473/556 |
| 2012/0277039 | A1* | 11/2012 | Severa | A63B 51/14 473/557 |
| 2017/0080298 | A1* | 3/2017 | Yadav | A63B 51/015 |

FOREIGN PATENT DOCUMENTS

| | | |
|---|---|---|
| DE | 4225473 | 2/1994 |

OTHER PUBLICATIONS

International Search Report and Written Opinion, dated Dec. 8, 2016, in connection with International Application No. PCT/US2016/053221.

* cited by examiner

*Primary Examiner* — Raleigh W Chiu
(74) *Attorney, Agent, or Firm* — Meunier Carlin & Curfman LLC

(57) ABSTRACT

A device is provided for stringing a racket having a racket frame with holes in the racket frame. The device includes a frame and a cradle rotationally coupled to the frame and configured to mechanically secure the racket via the racket frame. The device also includes multiple elements coupled to at least one of the frame and cradle, including a grasping element configured to engage a string and modify the position and/or tension of the string, a clamp configured to engage the string and maintain the position and tension of the string, an imagining device, and a processor, the processor capable of receiving information from the imaging device indicative of a racket position, hole position, and/or string position, and providing instructions for operating the grasping element, clamp, and/or cradle.

10 Claims, 6 Drawing Sheets

RACKET-STRINGING MACHINE

BACKGROUND

As a racket is used in play, the strings lose their tension over time and eventually require restringing. String tension is an important aspect of achieving reliable power from a racket. This is true for any racket that utilizes strings, such as for tennis, badminton, racquetball, squash, and so on.

Stringing a racket is a time- and labor-intensive endeavor. Even top-of-the-line professional machines still require substantial user input at each step of the process. A professional using a professional machine may still require over 30 minutes to string a single racket, with constant manual inputs required along the way. Several factors complicate the process of stringing a racket. One factor is tension. Each string must be tensioned at a precise level, and that tension needs to be consistent across all of the strings. Uneven tension in some strings will cause errant shots during play. As a result, while stringing a racket the user is constantly clamping and unclamping strings to maintain tension while feeding the string through the various holes in the racket's frame. Another factor is the process of weaving. While the "main" strings (typically aligned parallel to the longitudinal axis of the racket handle) are strung first, the "cross" strings (typically perpendicular to the main strings) must be weaved through the already-tensioned main strings. The tension in the main strings makes the weaving process more difficult and time consuming.

As a result, a need exists for a machine that can substitute some or all of the manual-labor aspects of racket stringing. The present disclosure provides a machine for automated racket stringing that is capable of identifying a type of racket, determining a type of string along with a desired string tension, and automatically string the racket at the desired tension.

Other systems, methods, features and/or advantages will be or may become apparent to one with skill in the art upon examination of the following drawings and detailed description. It is intended that all such additional systems, methods, features and/or advantages be included within this description and be protected by the accompanying claims.

SUMMARY

The following summary of the invention provides a basic understanding of some aspects of various embodiments of the present disclosure through the use of example embodiments. This summary is intended to supplement, and be read in conjunction with, at least the detailed description, claims, and drawings.

In one example embodiment, a device is provided for stringing a racket having a racket frame with holes in the racket frame. The device includes a frame and a cradle rotationally coupled to the frame. The cradle is configured to mechanically secure the racket via the racket frame. The device also includes a grasping element coupled to at least one of the frame and cradle and configured to engage a string and modify the position and/or tension of the string. The device further includes a clamp coupled to at least one of the frame and cradle and configured to engage the string and maintain the position and tension of the string. The device also includes an imagining device and a processor, the processor capable of receiving information from the imaging device indicative of a racket position, hole position, and/or string position, and providing instructions for operating the grasping element, clamp, and/or cradle.

The device can also include an actuator coupled to at least one of the frame and cradle and configured to modify the position of a tensioned main string. Further, the processor may be configured to provide instructions for operating the actuator. The device may also include a routing element couple at least one of the frame and cradle and configured to route a cross string perpendicular to the tensioned main string. Again, the processor may be configured to provide instructions for operating that actuator. The processor can also provide instructions at least partially based on the information received from the imaging device. The processor can also automatically obtain, via the Internet, information regarding the racket. Such information may include at least one of racket size, racket shape, racket model, hole layout, string size, and/or string tension. The device can further include a plurality of actuators coupled to at least one of the frame and cradle and configured to modify the position of a plurality of tensioned main strings in an alternating pattern. Continuing, the device can include a routing element coupled to at least one of the frame and cradle and configured to route a cross string perpendicular to the tensioned main strings in an over-under pattern. The device can also include a securing device coupled to at least one of the frame and cradle and configured to secure the tensioned string to the racket. The securing device can secure the tensioned string via at least one of mechanically tying, heating, melting, ultrasonic welding, gluing, and/or epoxying. Additionally or alternatively, the securing device can secure the tensioned string by mechanically coupling an anchor to the string.

In another embodiment, a method for stringing a racket is provided. The method includes securing the racket; gathering, via an imaging device, information regarding the racket; processing said information via a processor; providing, from the processor, instructions for causing the following steps to be carried out: feeding a string through a hole in the racket; tensioning the string; and clamping the tensioned string. The step of providing instructions can be based on at least some of the information processed via the processor. The instructions can further include biasing the tensioned string, and feeding an un-tensioned string perpendicular to the biased, tensioned string. The instructions may also include tensioning a plurality of main strings. Further, the instructions can include biasing fewer than all of the plurality of tensioned main strings, in an alternating order; and feeding a cross string through the plurality of tensioned main strings in an over-under manner. The instructions can also include securing the tensioned string to the racket. Securing may include at least one of mechanically tying, heating, melting, ultrasonic welding, gluing, epoxying, and/or mechanically coupling an anchor.

In another example embodiment, a method of identifying and stringing a racket is provided. The method includes, for example, gathering, via a camera, visual information regarding the racket; accessing, via a processor operatively connected to the camera, a database comprising information associated with a plurality of rackets; comparing the gathered visual information with the database information; and determining, based on the comparison, a stringing parameter of the racket, wherein said stringing parameter comprises at least one of a racket size, racket type, string layout, hole layout, recommended string size, and/or recommended string tension.

In yet another example embodiment, a method is provided for securing a string within a racket. The method can include providing a string having a mechanical stop on a first end; routing a second end of the string through a first hole;

routing the second end of the string through a second hole; tensioning the string such that the mechanical stop abuts the first hole; and securing the second end of the string via at least one of mechanically tying, heating, melting, ultrasonic welding, gluing, epoxying, and/or mechanically coupling an anchor.

Additional features and advantages of the invention will be made apparent from the following detailed description of illustrative embodiments that proceeds with reference to the accompanying drawings.

BRIEF DESCRIPTION OF THE DRAWINGS

The following detailed description will be better understood when read in conjunction with the appended drawings, in which there is shown one or more of the multiple embodiments of the present invention. It should be understood, however, that the various embodiments of the present invention are not limited to the precise arrangements and instrumentalities shown in the drawings.

DETAILED DESCRIPTION

A device is provided for stringing a racket having a racket frame with holes in the racket frame. The device includes a frame and a cradle rotationally coupled to the frame and configured to mechanically secure the racket via the racket frame. The device also includes multiple elements coupled to at least one of the frame and cradle, including a grasping element configured to engage a string and modify the position and/or tension of the string, a clamp configured to engage the string and maintain the position and tension of the string, an imagining device, and a processor, the processor capable of receiving information from the imaging device indicative of a racket position, hole position, and/or string position, and providing instructions for operating the grasping element, clamp, and/or cradle.

Figure 1:
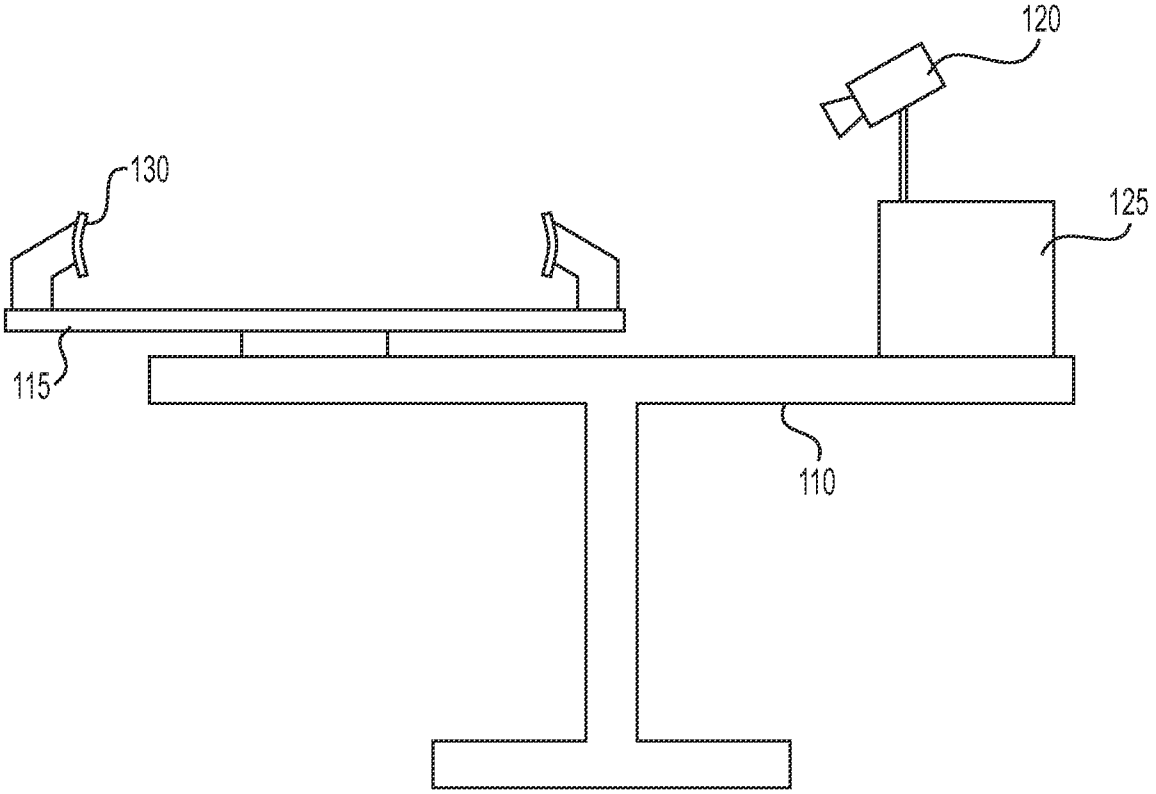
FIG. 1 is a side view of an example racket-stringing machine showing basic components.

FIG. 1 is a representative schematic depicting an example embodiment of a basic racket-stringing system. FIG. 1 shows a racket-stringing device with a frame 110 for supporting the various components of the device. The frame 110 is made from a heavy duty material, such as steel or aluminum, and is shaped to provide stability to the device as it rotates and otherwise works on a racket. Coupled to the frame 110 is a cradle 115. In some embodiments, the cradle 115 is rotationally coupled to the frame 110 such that it can rotate a full 360 degrees in both clockwise and counter-clockwise directions. A small motor may be used within the cradle 115 to provide electric power for rotating the cradle 115. The motor may be controlled by a computer 125 having a processor configured to process various types of information related to the racket, as described in more detail below. While the computer 125 is shown as being coupled to the frame 110, it may be located in a remote location. If located remotely, the computer 125 is configured to receive information and communicate instructions wirelessly.

Also shown in FIG. 1 is a camera 120. The camera 120 can be used to gather visual information about the particular racket to be strung, such as the number of holes in the racket, the size of the racket, and the racket's orientation relative to the cradle 115 and/or frame 110. The camera 120 provides information to the computer 125, allowing the computer 125 to process information and make further determinations. For example, the camera 120 may provide a visual image to the computer 125, and the computer 125 may access a database (either locally or via the Internet) to obtain further information about the racket such as the preferred string size, string tension, string layout, and so on. While the system is designed to operate with only one camera, any number of cameras may be utilized. Additional cameras can be used to increase the accuracy of the information provided to the computer 125.

The racket is secured to the cradle 115 via securing elements 130. At least two securing elements 130 are needed to secure the racket, but more may be used. Each securing element 130 includes at least one surface for contacting the frame of the racket and applying sufficient pressure to maintain the racket's position while the stringing process is ongoing. The securing elements 130 themselves are coupled to the cradle 115 such that they rotate with the cradle 115. In this manner the racket can be rotated as desired, either by hand or via an electric motor operatively coupled to the cradle 115.

Figure 2:
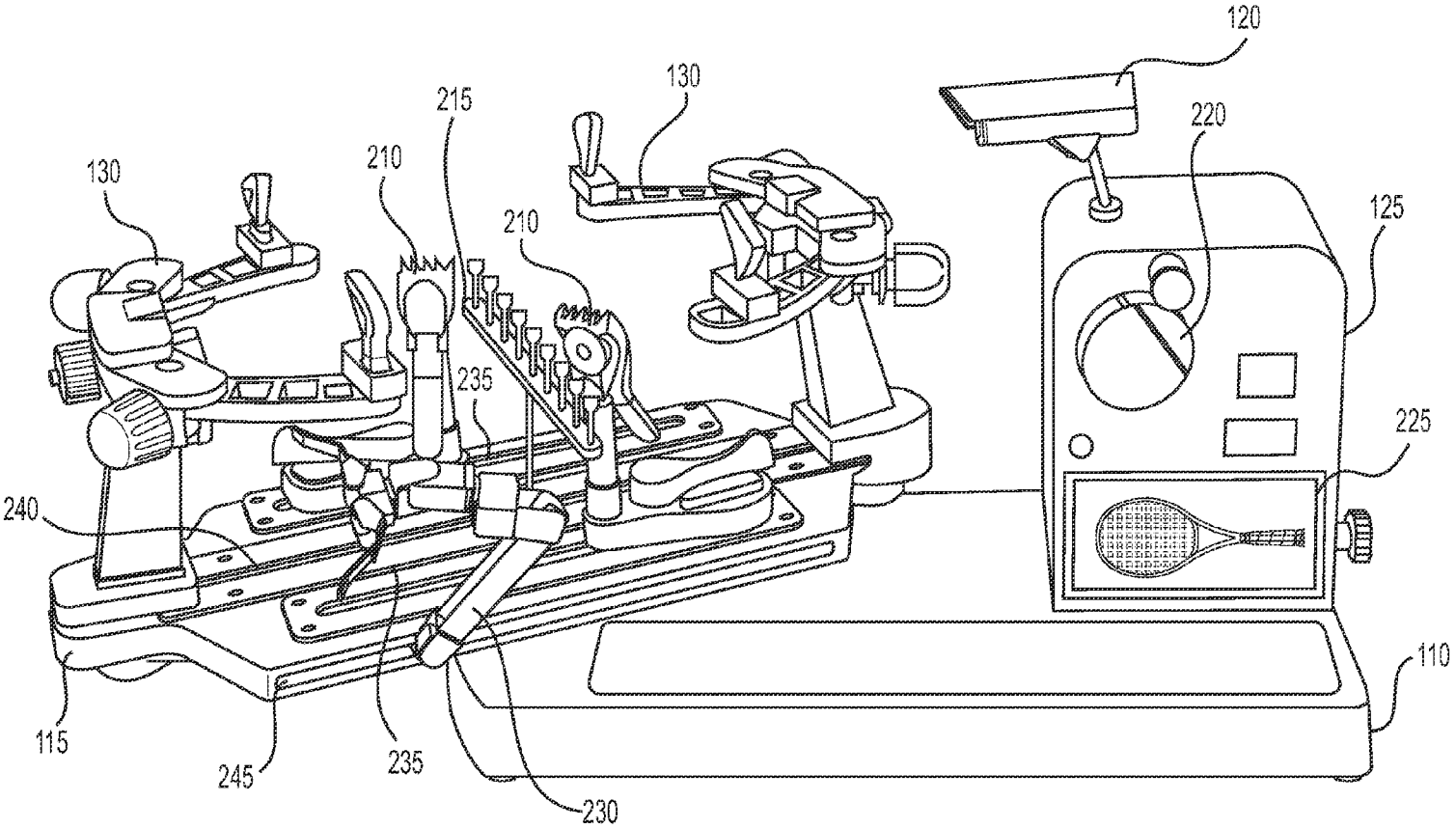
FIG. 2 is a perspective view of an example racket-stringing machine.

FIG. 2 shows a perspective view of a more detailed embodiment of a racket-stringing device. Structural features similar to those identified in FIG. 1 are labeled with matching element numbers. In the embodiment of FIG. 2, the computer 125 includes a display 225 for providing various types of information to a user. The face of the computer 125 may include buttons for operating the display 225. Alternatively or in addition, the display 225 may be connected, via the computer 125, to an external device such as a laptop or smartphone.

FIG. 2 shows a string tensioning device 220 attached to the computer 125. The string tensioning device 220 may be provided as a stand-alone device, or may not be provided at all. In some embodiments the strings are tensioned by a grasping element 230, as explained further below. In other embodiments the grasping element 230 positions a string within the tensioning device 220 to achieve the desired tension for the string.

The grasping element 230 may be attached to the frame 110 or the cradle 115. In FIG. 2 the grasping element 230 is attached to the cradle 115, and more particularly to a side slot 245 running along the side of the cradle 115. The racket stringing device may have one grasping element 230 or may have a plurality of grasping elements 230. The grasping element 230 obtains instructions from a processor of the computer 125 and modifies the positions of strings during the racket-stringing process. For example, the grasping element 230 may pick up a piece of string from a dispensing area, feed the string through a hole in the racket, and then pull the string to a corresponding hole on the opposite side of the racket. Alternatively, the grasping element 230 may pass the string off to a different grasping element 230 located on an opposite side of the racket frame in order to maintain contact with the string at all times and increase accuracy. The grasping element 230 is configured to provide a calculated amount of tension to the string as it is strung through the racket. The string tension may be set at predetermined intervals, or may be maintained through the entire stringing process.

One or more clamps 210 may also be utilized to maintain string tension. FIG. 2 shows two clamps 210, each mounted along a slot 235 in the cradle 115. The clamps 210 may be moved, either manually or automatically, along each corresponding slot 235. In order to orient the clamps 210 to both main string and cross strings, the clamps 210 can be rotationally mounted within the slots 235 and can be manually or automatically rotated 360 degrees to match the orientation of the racket strings. The clamps 210 operate to hold a string in a particular position, thereby maintaining tension. The clamps 210 may be used in conjunction with the grasping element 230 to maintain tension as the grasping element 230 routes the un-tensioned portion of a string throughout the racket.

FIG. 2 also shows an actuator 215. One purpose of the actuator 215 is to modify the position of tensioned main strings in order to allow for a cross string to be routed. This is described in more detail with respect to FIG. 4. The actuator 215 is located within a central slot 240 and may slide back and forth within that slot 240 as desired. The actuator 215 may also rotate in order to position the actuator 215 appropriate as well as move the actuator 215 out of the way when necessary. For example, in some embodiments the actuator 215 can be rotated such that the length of the actuator 215 corresponds with the center slot 240, and the actuator 215 may be retracted to fit partially or even wholly within the slot 240. In use, the actuator 215 is pushed upward to bias every other tensioned main string to facilitate weaving a cross string through.

Figure 3:
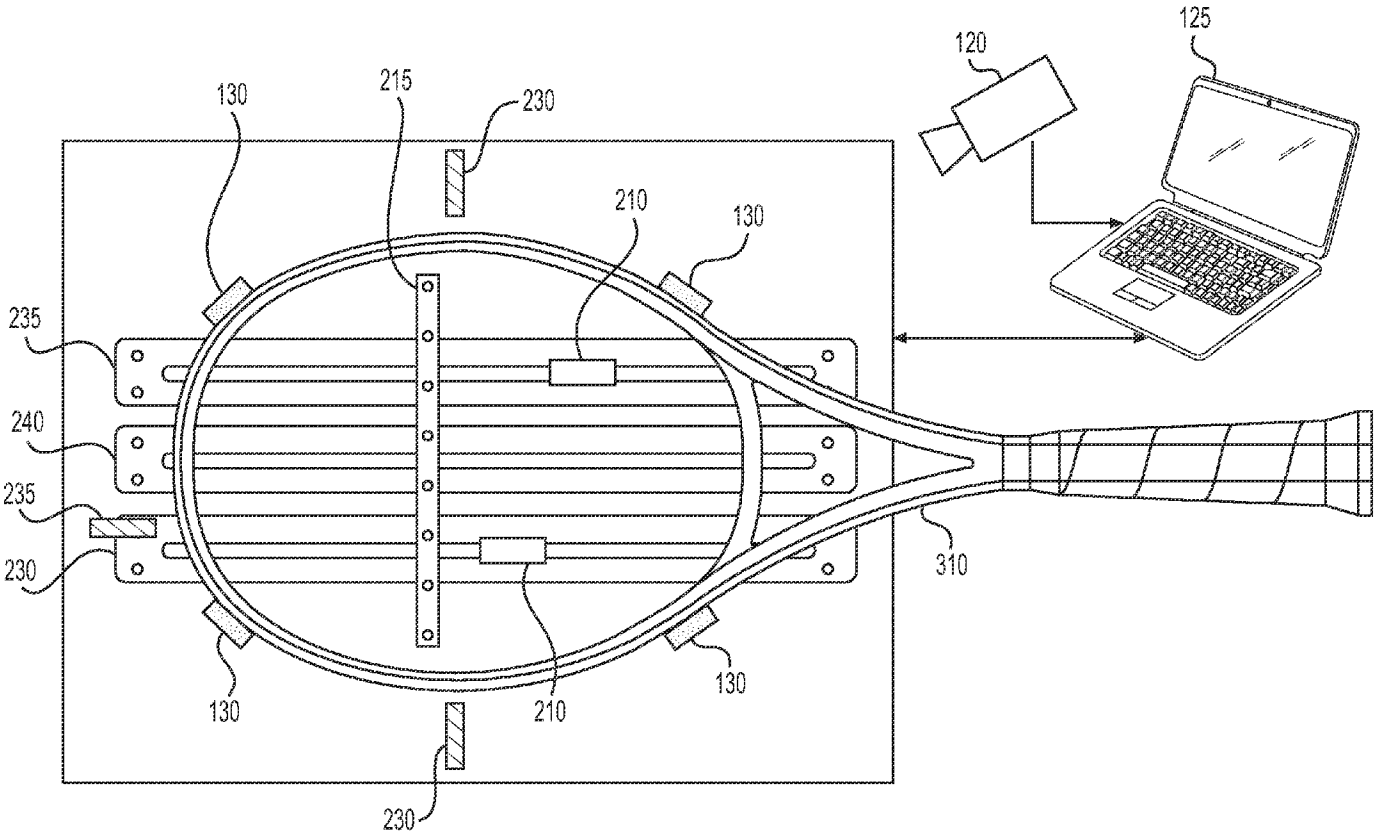
FIG. 3 is a top view of an example racket-stringing machine and associated electronics.

FIG. 3 shows a top-down view of an example racket-stringing device with a racket 310 secured to the device via securing elements 130 of the cradle 115. Camera 120 and computer 125 are also shown in communication with the rest of the racket-stringing device. In this embodiment the camera 120 and computer 125 are wirelessly connected to one another and to the rest of the device. Of course, hardwire connections may be used instead of, or in addition to, the wireless connections.

FIG. 3 also shows three grasping elements 230. Although the grasping elements 230 are represented as blocks, they may take the form of the grasping element 230 shown in FIG. 2. These grasping elements 230 can be used to route both main strings and cross strings, set tension of the strings, and tie off or otherwise secure strings to the racket 310 after routing them. Clamps 210 are shown slidably mounted in slots 235, while the actuator 215 is shown slidably mounted in center slot 240.

Figure 4:
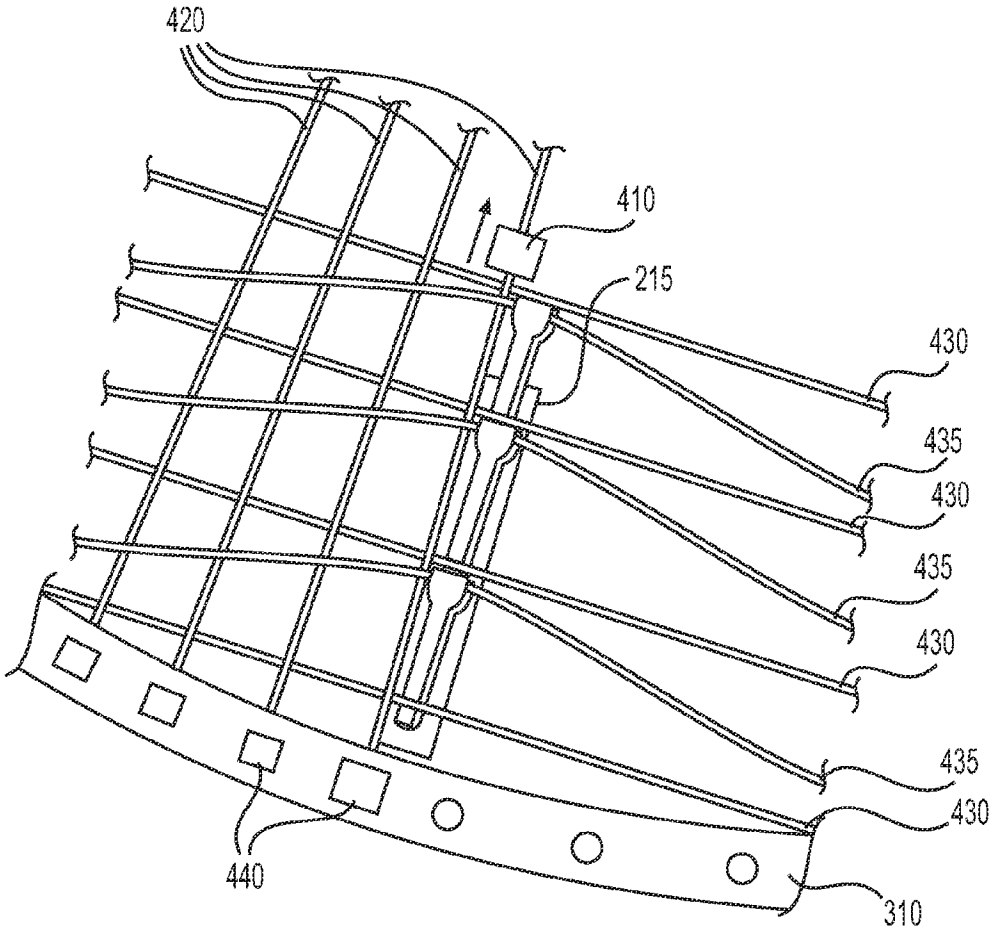
FIG. 4 is a zoomed perspective view of an example actuator modifying the position of tensioned main strings while an example grasping element modifies the position of a cross string.

The actuator 215 is configured to engage at least one of the main strings after the main strings have been tensioned and secured. As shown in FIG. 4, the actuator 215 can engage, for example, every other main string. In FIG. 4 the actuator 215 is shown engaging main strings 435 while not engaging main strings 430. The actuator 215 lifts every other main string 435 to allow for a routing element 410 to route a cross string 420 through the main strings 430, 435. Because the actuator 215 has moved main strings 435 relative to main strings 430, the routing element 410 is able to route cross string 420 in a weaved, over-under pattern through the main strings 430, 435.

In the embodiment shown in FIG. 4, three cross strings 420 have already been routed by the routing element 410, and a fourth cross string 420 is shown being routed. As each cross string 420 is routed, the actuator 215 moves in a direction parallel to the main strings, in an amount corresponding to the holes through which the next cross string will be routed. In this embodiment, each cross string 420 that has been routed has been secured to the frame of the racket 310 via anchors 440.

The anchors 440 may be mechanical in nature, such as a clamp, crimp, or clip that attaches to the string and prevents the string from being pulled through the holes in the racket 310. Alternatively, the anchors 440 may be a manipulation of the string itself, such as, for example, a knot tied in the string, a melted portion of string, an ultrasonically welded portion of string, and so on. The anchors 440 may also be glued or epoxied, or otherwise bonded to the racket 310 to prevent the string from pulling through.

Figure 5:
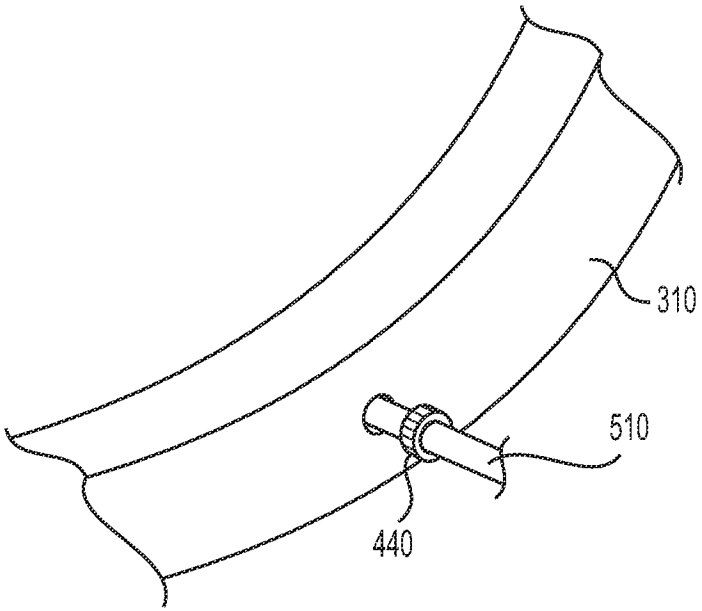
FIG. 5 is a perspective view of an example anchor affixed to a string to maintain tension and string position.

An anchor 440 may also be used to secure the string on the opposite side of the racket. For example, FIG. 5 shows a string 510 that has been pulled through a hole in the racket 310. An anchor 440 is affixed to the string 510 in a manner such that the anchor 440 maintains its position on the string 510 and prevents the string 510 from being pulled back through the hole in the racket 310. The anchor may be affixed by the grasping element 230, the routing element 410, or another device dedicated to securing anchors 440 to the string 510.

All of the mechanical elements described herein may be controlled via a computer, and more precisely through a processor associated with a computer. Those skilled in the art will recognize that the program instructions for software applications implementing all or a portion of one or more embodiment(s) of the present disclosure may be written in a programming language such as Java or C++, and that the database may be implemented with a database package such as Microsoft Access™ or a database management system (DBMS) such as Microsoft SQL Server™, Microsoft SQL Server CE™, IBM DB2™, MySQL, or postgreSQL.

Figure 6:
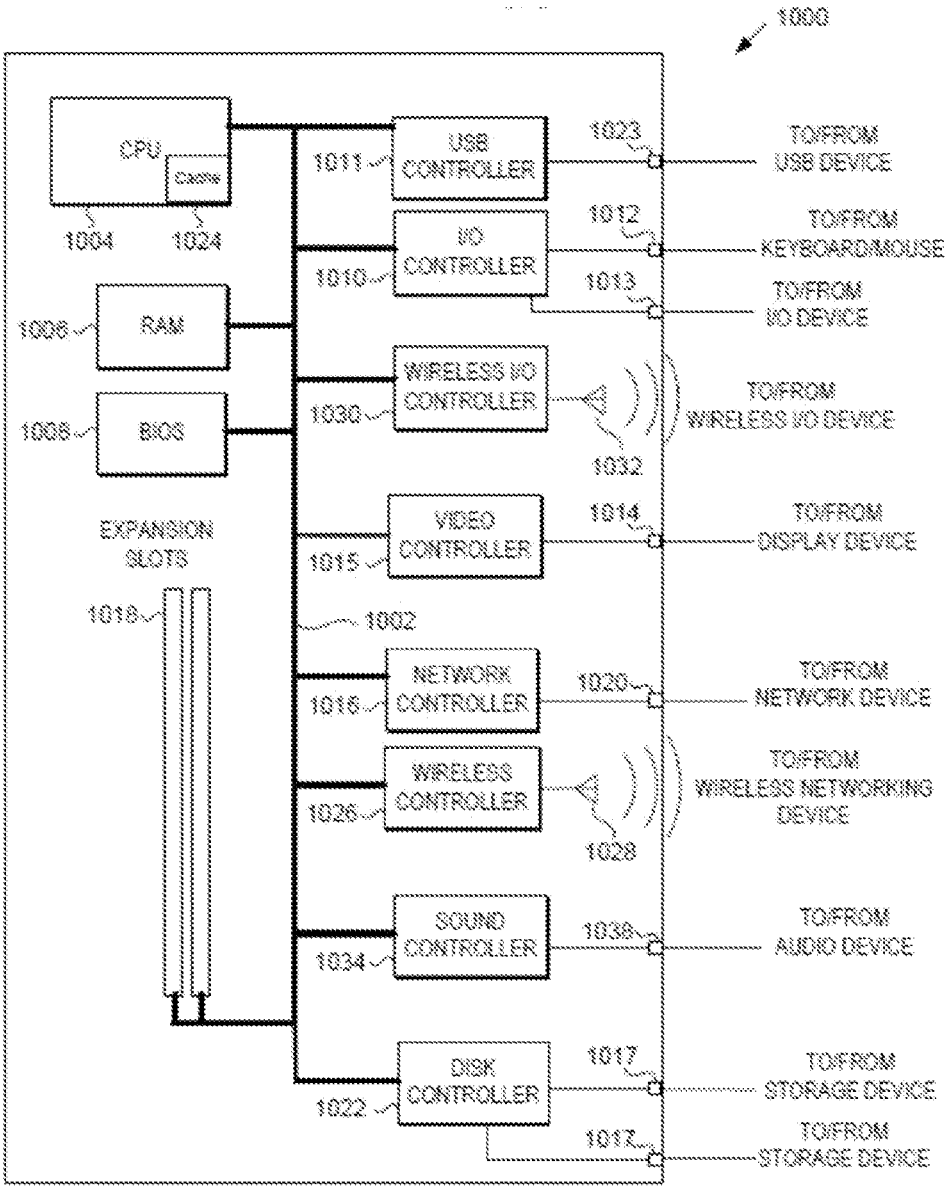
FIG. 6 is a block diagram illustrating a computer architecture a system through which the embodiments of the present disclosure may be implemented.

FIG. 6 is a block diagram illustrating a computer architecture of the system 1000 through which the embodiments of the present disclosure may be implemented. A system bus 1002 transports data amongst the Central Processing Unit (CPU) 1004, RAM 1006, the Basic Input Output System (BIOS) 1008 and other components. The CPU 1004 may include a cache memory component 1024. The computer system 1000 may include one or more external storage ports 1017 for accessing a hard disk drive (HDD), optical storage drive (e.g., CD-ROM, DVD-ROM, DVD-RW), flash memory, tape device, or other storage device (not shown). The relevant storage device(s) are connected through the external storage port 1017 which is connected to the system bus 1002 via a disk controller 1022. A keyboard and/or pointing device (e.g., mouse, touch pad) can be connected to the keyboard/mouse port(s) 1012, and other I/O devices could be connected to additional I/O port(s) 1013, which are connected to the system bus 1002 through the I/O controller 1005. Additional ports or devices, such as serial ports, parallel ports, firewire adapters, or biometric devices (not shown), may be utilized through the I/O controller 1010. A display device can be connected to a display device port 1014 which is connected to the system bus 1002 through the video controller 1015. A network device (not shown), including but not limited to an Ethernet device or other device having networking capability, can be connected to a network port 1020 which is connected through the network controller 1016 to the system bus 1002.

The computer system 1000 may be wirelessly connected to a network device that is configured for wireless operation (not shown), including but not limited to wireless routers, using an antenna 1028 connected to a wireless controller 1026 connected to the system bus 1002, where the antenna transmits/receives signals to/from the network device. The computer system 1000 may include one or more USB ports 1023. A USB device (not shown), including but not limited to a printer, scanner, keyboard, mouse, digital camera, storage device, PDA, cellular phone, biometric device, web-cam, and I/O adapters can be connected to the USB port 1023 which is connected to the system bus 1002 through the USB controller 1011. Other devices, such as cellular phones, PDAs, and other portable devices may also be connected wirelessly via a wireless I/O antenna 1032 that is connected to a wireless I/O controller 1030. Examples of wireless I/O technologies include, but are not limited to, Bluetooth, Infrared (IR), and Radio-Frequency (RF). Audio devices, such as microphones, speakers, or headphones may be connected to a sound port 1038 that is connected to a sound controller 1034 that is connected to the system bus 1002. Expansion slots 1018 can include Industry Standard Architecture (ISA) slots, Peripheral Component Interconnect (PCI) expansion slots, PCI Express expansion slots, Accelerated Graphics Port (AGP) slots or any other slot generally known in the art to allow additional cards to be placed into the computer system 1000. These slots can be used to connect network cards, video cards, sound cards, modems and any other peripheral devices generally used with a computer. The computer system 1000 also includes a source of power (not shown), including but not limited to a power supply connected to an external source of power, and/or an internal or external battery. These devices are generally well-known to those skilled in the art, and a detailed discussion thereof is omitted here for convenience only and should not be considered limiting.

The embodiments of the present disclosure can be included in an article of manufacture (e.g., one or more computer program products) having, for instance, computer useable or computer readable media. The media has embodied therein, for instance, computer readable program code means, including computer-executable instructions, for providing and facilitating the mechanisms of the embodiments of the present disclosure. The article of manufacture can be included as part of a computer system or sold separately.

While specific embodiments have been described in detail in the foregoing detailed description and illustrated in the accompanying drawings, it will be appreciated by those skilled in the art that various modifications and alternatives to those details could be developed in light of the overall teachings of the disclosure and the broad inventive concepts thereof. It is understood, therefore, that the scope of the present disclosure is not limited to the particular examples and implementations disclosed herein, but is intended to cover modifications within the spirit and scope thereof as defined by the appended claims and any and all equivalents thereof.

What is claimed is:

1. A device for stringing a racket having a racket frame comprising holes, the device comprising:

a frame;

a cradle rotationally coupled to the frame and configured to mechanically secure the racket via the racket frame;

a grasping element coupled to at least one of the frame and cradle and configured to engage a string and modify the position and/or tension of the string;

a clamp coupled to at least one of the frame and cradle and configured to engage the string and maintain the position and tension of the string;

an imaging device; and a processor configured to:

receive information from the imaging device indicative of a racket position, hole position, and/or string position; and provide instructions for operating the grasping element, clamp, and/or cradle.

2. The device of claim 1, further comprising an actuator coupled to at least one of the frame and cradle and configured to modify the position of a tensioned main string.

3. The device of claim 2, wherein the processor is configured to provide instructions for operating the actuator.

4. The device of claim 2, further comprising a routing element coupled to at least one of the frame and cradle and configured to route a cross string perpendicular to the tensioned main string.

5. The device of claim 4, wherein the processor is configured to provide instructions for operating the actuator.

6. The device of claim 1, further comprising a plurality of actuators coupled to at least one of the frame and cradle and configured to modify the position of a plurality of tensioned main strings in an alternating pattern.

7. The device of claim 6, further comprising a routing element coupled to at least one of the frame and cradle and configured to route a cross string perpendicular to the tensioned main strings in an over-under pattern.

8. The device of claim 1, wherein said instructions provided by the processor are at least partially based on the information received from the imaging device.

9. The device of claim 1, wherein the processor is configured to automatically obtain, via the Internet, information regarding the racket.

10. The device of claim 9, wherein said information comprises at least one of racket size, racket shape, racket model, hole layout, string size, and/or string tension.

* * * * *